US008800445B2

(12) United States Patent
Rogge et al.

(10) Patent No.: US 8,800,445 B2
(45) Date of Patent: Aug. 12, 2014

(54) PRINTING PLATE CYLINDER REGISTRATION

(75) Inventors: Uwe Rogge, Lengerich (DE); Dietmar Koopmann, Lienen (DE); Manfred Loddenkoetter, Ibbenbueren (DE)

(73) Assignee: Windmoeller & Hoelscher KG, Lengerich (DE)

( * ) Notice: Subject to any disclaimer, the term of this patent is extended or adjusted under 35 U.S.C. 154(b) by 661 days.

(21) Appl. No.: 11/665,861

(22) PCT Filed: Oct. 3, 2005

(86) PCT No.: PCT/EP2005/010692

§ 371 (c)(1),
(2), (4) Date: Apr. 20, 2007

(87) PCT Pub. No.: WO2006/042637

PCT Pub. Date: Apr. 27, 2006

(65) Prior Publication Data

US 2008/0105149 A1 May 8, 2008

(30) Foreign Application Priority Data

Oct. 20, 2004 (DE) ..... 10 2004 051 041

(51) Int. Cl.

| | |
|---|---|
| ***B41F 27/06*** | (2006.01) |
| ***B41F 27/10*** | (2006.01) |
| ***B41F 27/00*** | (2006.01) |
| ***B41F 27/14*** | (2006.01) |

(52) U.S. Cl.

CPC ..... *B41F 27/005* (2013.01); *B41F 27/105* (2013.01); *B41F 27/14* (2013.01); *Y10S 101/36* (2013.01)

USPC ..... 101/383; 101/378; 101/DIG. 36

(58) Field of Classification Search

USPC ..... 101/383

See application file for complete search history.

(56) References Cited

U.S. PATENT DOCUMENTS

| | | | | | |
|---|---|---|---|---|---|
| 2,180,440 | A | * | 11/1939 | Stone | 101/477 |
| 2,277,405 | A | * | 3/1942 | McKiernan | 101/DIG. 36 |
| 2,631,349 | A | * | 3/1953 | Houston | 101/415.1 |
| 2,913,093 | A | * | 11/1959 | Bevan | 400/616.3 |
| 3,103,880 | A | * | 9/1963 | Sanford et al. | 101/DIG. 36 |
| 3,456,587 | A | * | 7/1969 | Hulen | 101/415.1 |
| 5,209,163 | A | * | 5/1993 | Banike | 101/483 |
| 5,216,954 | A | * | 6/1993 | Thompson | 101/375 |

(Continued)

FOREIGN PATENT DOCUMENTS

| | | |
|---|---|---|
| DE | 41 40 768 A1 | 6/1993 |
| DE | 43 41 246 C1 | 2/1995 |

(Continued)

*Primary Examiner* — Jill Culler

(74) *Attorney, Agent, or Firm* — Jacobson Holman, PLLC.

(57) ABSTRACT

A printing plate cylinder for a printing machine has a rotatable cylinder mandrel and a sleeve that is at least partially positionable over the cylinder mandrel. The angular positions of the mandrel and the sleeve are alignable to each other by a male register element which is fixed on one of the two elements to be aligned, and a female register element which is part of the corresponding other element to be aligned. Both the male and female register elements remain in working connection with each other if the elements to be aligned are in the set position relative to each other. At least one of the male and female register elements is controlled by movement of the other element to be aligned.

13 Claims, 3 Drawing Sheets

(56) References Cited

U.S. PATENT DOCUMENTS

| | | | | |
|---|---|---|---|---|
| 5,379,693 | A | 1/1995 | Hoffmann et al. | |
| 5,485,679 | A * | 1/1996 | Ternes | 33/623 |
| 5,551,339 | A * | 9/1996 | Schadlich et al. | 101/375 |
| 5,557,960 | A | 9/1996 | Hoffmann et al. | |
| 5,778,779 | A * | 7/1998 | Jones et al. | 101/DIG. 36 |
| 6,186,065 | B1 | 2/2001 | Kersch et al. | |
| 6,283,026 | B1 * | 9/2001 | Tocheport et al. | 101/375 |
| 6,300,971 | B1 * | 10/2001 | Masotta et al. | 101/DIG. 36 |
| 6,443,065 | B1 | 9/2002 | Charette et al. | |
| 6,792,858 | B2 * | 9/2004 | Kolbe et al. | 101/375 |

FOREIGN PATENT DOCUMENTS

| | | | |
|---|---|---|---|
| DE | 198 48 184 | A1 | 5/2000 |
| EP | 0 222 033 | A1 | 5/1987 |
| EP | 0 619 185 | A1 | 10/1994 |
| EP | 0 782 919 | A1 | 7/1997 |
| EP | 1 155 838 | A2 | 11/2001 |

* cited by examiner

PRINTING PLATE CYLINDER REGISTRATION

CROSS-REFERENCE TO RELATED APPLICATION

This is a national stage of PCT/EP05/010692 filed Oct. 3, 2005 and published in German.

BACKGROUND OF THE INVENTION

1. Field of Invention

The invention relates to a printing plate cylinder that includes a cylinder mandrel and a sleeve, and a male register element and a female register element that facilitate the alignment of the mandrel and the sleeve.

2. Description of the Prior Art

In this print from printing plate cylinder those types of print cylinders are understood which carry a print impression. Printing plate cylinders are often made from different cylindrical shaped elements. As a rule a rotary base mandrel fixed at a machine frame forms the core of such a printing plate cylinder. It is clear that for changing tasks this mandrel is acted on by different print sleeves which carry different print impressions. For this purpose the printing sleeve is pulled over the base mandrel.

Besides these printing sleeves there are also known adapter sleeves which are also pulled over the base mandrel and fit the circumference of the thus formed cylinder core to the individually required print length. Often over this adapter sleeve either a further adapter cylinder or a print sleeve is slid anew. Such methods are for example known from Flexo Printing. In particular in Flexo Package Printing one has to do with a number of different print lengths which require many different adapters. The corresponding printing requirements are often satisfied with central cylinder flexo print machines. There are many adapter machines under these machines. The printing cases of these machines often carry a print-sleeve or a print-plate made from one of flexible material characteristic of flexo-print.

For all multi-color print processes the necessity to perform a register control or regulation is known to arise. It needs to begin with a basic determination of the position of different parts of the printing plate cylinder (such as printing mandrel and printing sleeve) to each other.

Thus EP 782 919 A1 suggests for setting up of side registers, to pull a printing sleeve axially over a print mandrel till the front end of this sleeve arrives at a pin on the mandrel acting as a block. The axial position of the sleeve on the mandrel is determined because a further moving pin on the circumferential surface of the mandrel is backed out in radial direction and works against the back end of the sleeve.

For this purpose the position of the print impression in the different color works relative to each other has to be determined. Therefore the position of the print impression relative to the base mandrel of the machine control or the machine operator must be known. For this the base mandrels of the print cylinder normally have register pins which protrude from the circumferential surface of the mandrel. The sleeves which cover the base mandrel have slots in which the pins either grip or snap if the sleeve reaches its set position relative to the mandrel. In this way the angular position of the sleeve to the mandrel is aligned and determined. If the sleeve is an adapter sleeve then at least a further sleeve—namely the print sleeve at least—must be brought to a fixed angular position on this sleeve and thus on the base mandrel. For this purpose the adapter sleeve has a register pin again which protrudes from its outer surface and grips a slot of the further sleeve for this purpose when it reaches its set position. This form of preregistering had been known for a long time and is well implemented even in the so called directly driven print machines in which each print plate cylinder has its own drive as well as in machines in which operational connections exist between different cylinders. Printing plate cylinders which are made from such base mandrels and sleeves and are aligned or registered in this way can be described in the following way:

Printing plate cylinder which at set up of the printing machine is made from at least following cylindrical shaped elements:

A cylinder core which is placed in the print machine as rotary and a sleeve which can be pulled over the cylinder core at least partly whereby the angular position of both these elements to each other is settable as adjustable through following means:

A male register element which is fixed on one of the two elements to be aligned, a female register element which is part of the corresponding other element to be aligned, whereby both the register elements previously mentioned stand in working connection with each other if the elements to be aligned are in the set position relative to each other.

The print sleeve of one such printing plate cylinder is described in DE 41 40 768 A1.

Here it is to be observed that a cylinder core in above sense is often understood to be the base mandrel. However in the sense of this print the concept cylinder core also includes a base mandrel which is acted upon with one or several sleeves. A male register element is often available as a pin or some other protrusion which protrudes from the outer circumferential surface of the cylinder core or the inner circumferential surface of a further sleeve. A female register element is in the position to make a working connection—in first line a form of binding—with the male register element.

At set up or putting together of this printing plate cylinder according to current technology however there appear damages on register elements as well as on the sleeves. This can be attributed to the fact that the sleeves are not slid correct to the angle on the cylinder core so that the female register elements—in first line as slots—miss the register pins whereby at the end of the sliding movement it comes to collisions between the edges of the sleeves and the male register elements—up to now pins as a rule. Damages on the register elements as well as the edges of the wrapped sleeves are the result.

SUMMARY OF THE INVENTION

The task of the present invention is it to reduce these damages. This task is achieved through that At least one of the two register elements is controlled by the other element to be aligned through movement.

Further implementation examples and details of the present invention follow in the detailed examples and corresponding description.

DETAILED DESCRIPTION OF THE PREFERRED EMBODIMENTS

Figure 1A:
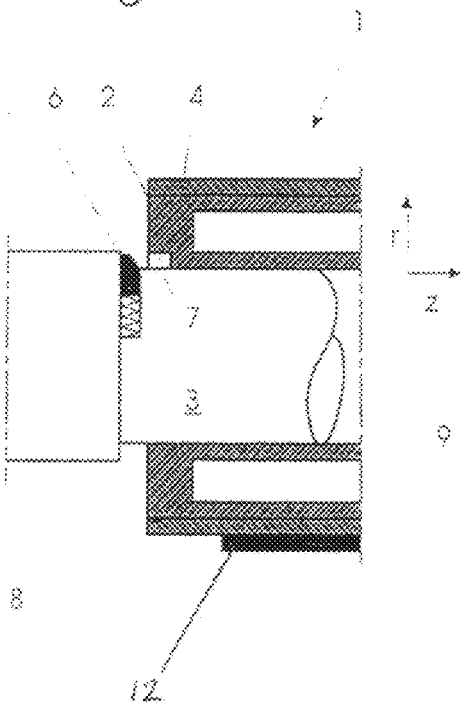
FIG. 1*a* A section A-A through a printing plate cylinder according to the invention during a phase of the set-up process FIG. 1*b* A section A-A through the same printing plate cylinder according to the invention as in figure la during a phase of the set-up process FIG. 2*a* A section A-A through the same printing plate cylinder according to the invention as in FIG. 1*a* during another phase of the set-up process FIG. 2*b* A section B-B through the same printing plate cylinder according to the invention as in FIG. 1*a* during another phase of the set-up process FIG. 3*a* A section A-A through the same printing plate cylinder according to the invention as in FIG. 1*a* at the end of the set-up process FIG. 3*b* A section D-D through the same printing plate cylinder according to the invention as in FIG. 1*a* at the end of the set-up process FIG. 4 A section in the axial-radial plane through another implementation example of a cylinder according to the invention FIG. 5 A section in the axial-radial plane through the implementation example shown in FIG. 4 of a cylinder according to the invention FIG. 6 A section in the axial-radial plane through another implementation example of a cylinder according to the invention

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIG. 1 shows a printing plate cylinder 1 which is just being set up. In this an adapter sleeve 2 in the axial direction z of the printing plate cylinder is being shifted on the cylinder mandrel 3. On the adapter sleeve 2 is the print sleeve 4, on which the printing plate 12 is placed. The description and illustration are associated with a flexo-print cylinder.

Figure 3A:
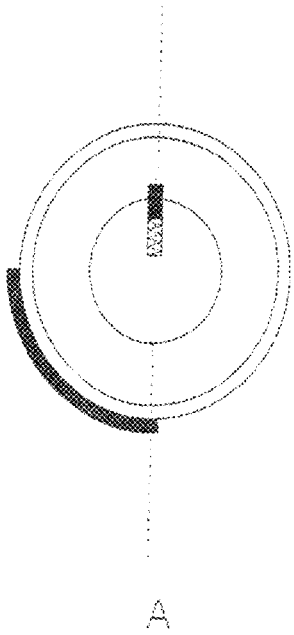
Figure 3B:
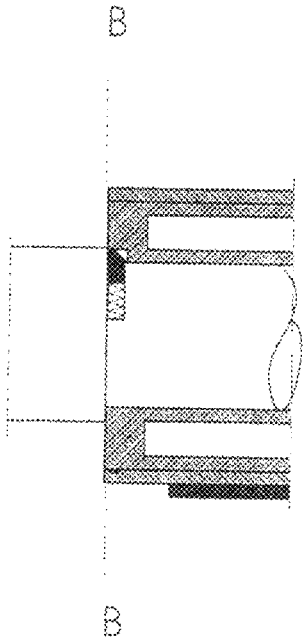

In FIG. 1*a* it can be seen that the angular position between the male register element, here the pin 6, and the female register element, here the slot 7, is correctly set up. During further shifting of the adapter sleeve 2 on the cylinder mandrel 3 the adapter sleeve 2 reaches the position which is shown in the FIGS. 3*a* and 3*b*. Here the male register element, the register pin 6, will grip the female register element, the slot 7, and thus fix the angular position of the cylinder mandrel 3 to the adapter sleeve 2. During further sliding in the previous process, the adapter sleeve 2 will move against the block 8. In this way the axial movement of the sleeve 2 is ended.

Figure 1B:
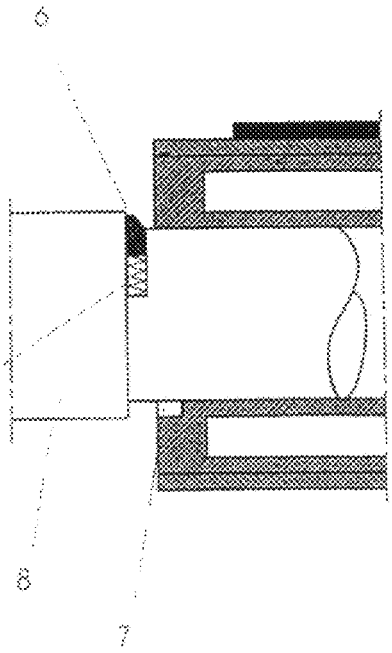
Figure 2A:
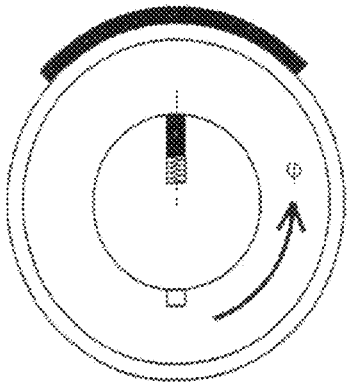
Figure 2B:
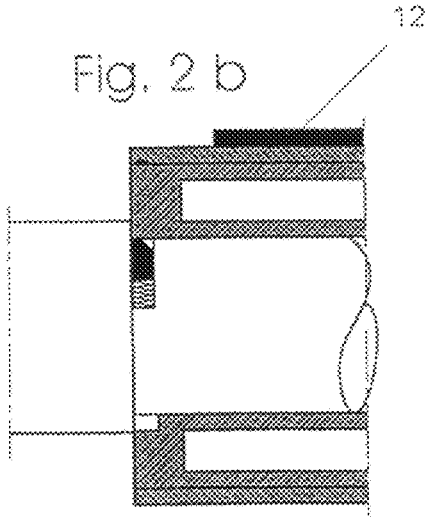

The FIGS. 1*b*, 2*a*, 2*b*, 3*a* and 3*b* show the same implementation example of a printing plate cylinder according to the invention as the FIG. 1*a*. However in FIG. 1*b* the start position of the set up process is different from that in FIG. 1*a*. In FIG. 1*b* the angular position of the slot 7 against the register pin 6 is different. Because of reasons of display both these elements are shown angularly separate by 180°. However to each specialist it is clear that in practice smaller angular deviations appear which however already lead to damages in printing plate cylinders according to the current state of technology. Despite the angular separation of the adapter sleeve 2 against the cylinder mandrel 3 the adapter sleeve 2 moves against the block 8. Thus here the register pin 6 will be pressed under through the edge of the adapter sleeve 2. Thus the spring element 9 will become tense. The situation arising here is shown in the FIGS. 2*a* and 2*b*. The adapter sleeve 2 has reached the block 8, the male register element 6 is however pressed down, the female register element 7 is still shifted about 180° against the male register element 6. Therefore the adapter sleeve 2 is slid in circumferential direction $\phi$, until it reaches the situation shown in the FIGS. 3*a* and 3*b*. Here the adapter sleeve 2 is rotated so long until the slot 7 comes to the pin 6, so that between both these elements a working connection can begin. In this case this will be caused by the spring 9, because spring 9 presses the register pin 6 in the slot 7. Thus the set up process concerning the adapter sleeve and the cylinder core ends.

Figure 4:
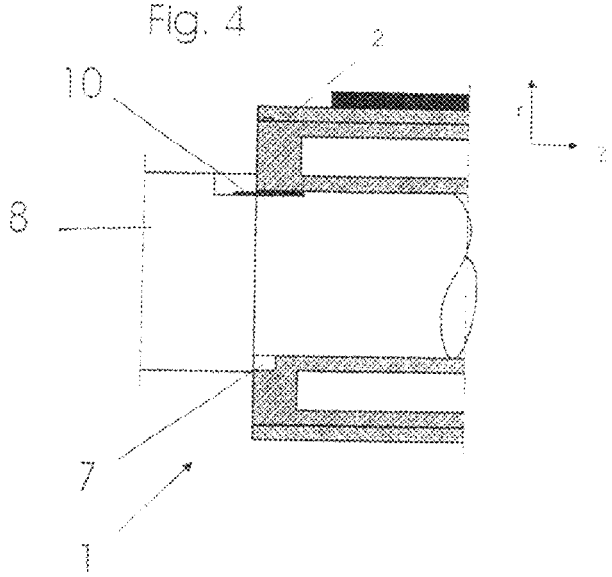

In FIG. 4 is shown another implementation example of a printing plate cylinder according to the invention. However here the male register element 10 is not in the form of a pin, but the complete male register element is a spring plate 10, which in FIG. 4 is being pressed on the surface through the edge of the adapter sleeve 2. It can also be recognized in FIG. 4 that this implementation example of a printing plate cylinder according to the invention has an adapter sleeve 2 with a slot 7. Also this slot 7 works as female register element.

Figure 5:
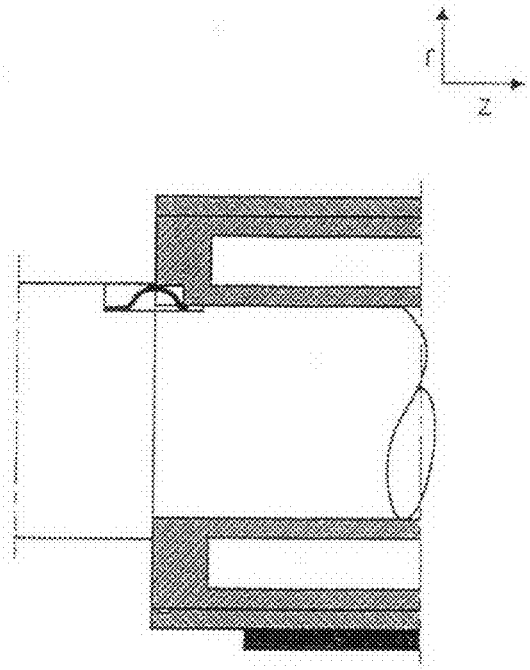

In the situation shown in FIG. 4 the adapter sleeve has already reached its axial end position at the block 8. After that it will be rotated in its circumferential direction against the mandrel, until the slot 7 reaches the register element 10 and as shown in FIG. 5, pushes this out over the circumferential surface of the cylinder core through its spring force and in this way grips in the slot 7, whereby the angular position of the adapter sleeve 2 against the cylinder mandrel 3 is fixed.

Figure 6:
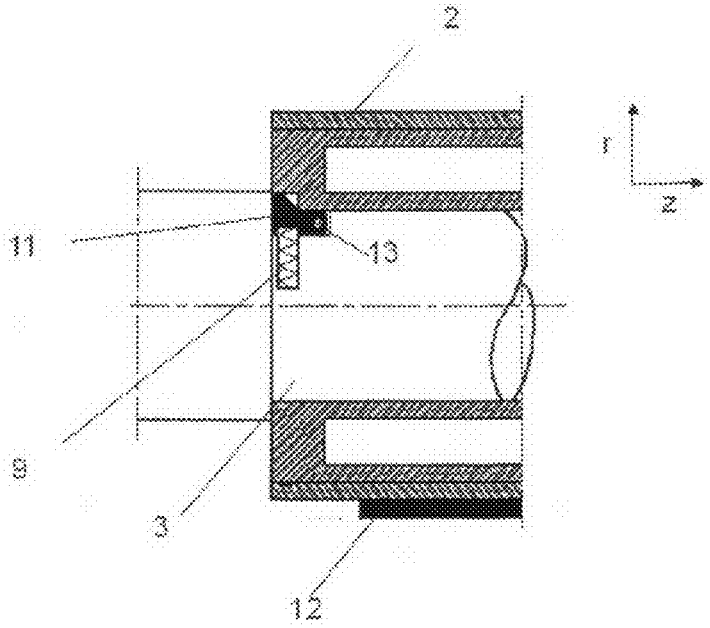

In FIG. 6 is shown another implementation example of a printing plate cylinder according to the invention whereby the adapter sleeve 2 and the cylinder mandrel 3 of this printing plate cylinder have already reached their working position in their axial direction and in their angular position. The difference to the implementation examples shown before lies again in the furnishing of the male register element 11, which is fixed on the cylinder mandrel 3 through a rotation axis 13 about which the male register element 11 can swivel or rotate (an axial end view of the rotation axis 13 being shown in FIG. 6). As a result of the rotation axis 13, the male register element 11 executes, if it is moved by the adapter sleeve 2, the movement in the radial and axial direction of the printing plate cylinder. It will still be revealed among others in the subclaims that there are alternatives to the shown implementation examples and the described set up procedures. Thus for example register elements can be thought of which can only move in the axial direction. Furthermore it is conceivable to shape only the female register elements in some form when shifting. The blocks can be shown differently than in the present implementation examples. Thus for example, it is possible to include pins in the cylinder core which take over the function of the block. Here it is advantageous to make the blocking surface of this pin larger than the register pin used up to now to make the pressure effect, which appears by the collision of the adapter with these pins, smaller than the collision pressure which occurs up to now during collisions with the register pins. The setting of the angular position and the adapter sleeve to each other can naturally also be undertaken because the cylinder core is rotated against the adapter sleeve. This is possible without anything further because currently the cylinder core is furnished as rotary in rotation pressure machines. Also bringing the male register element on the adapter or a further sleeve as well as the female register element on the cylinder core is advantageous in certain use scenarios. Particularly limited are the displays of the invention undertaken in the present diagrams regarding the cylinder core and the adapter sleeve. Already in the introductory description it was mentioned that under the concept of cylinder core can even be understood a unit of base mandrel and an adapter sleeve. In this case the outer circumferential surface of the adapter sleeve is provided with a further register element. The next sleeve which is pulled on the adapter sleeve then has the counter piece to this register element and will be furnished according to the invention. Preferred application fields for the present invention are the flexo-print, here in particular the Flexo Package Print with central cylinder machines.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| Reference Diagrams List | |
|---|---|
| 1 | Printing Plate Cylinder |
| 2 | Adapter Sleeve |
| 3 | Cylinderical Mandrel |
| 4 | Print Sleeve |
| 5 | |
| 6 | Register Pin |
| 7 | Slot |
| 8 | Block |
| 9 | Spring Element |
| 10 | Male Register Element/Spring Plate |
| 11 | Rotary Register Pin |
| 12 | Print Plate |
| z | Axial Direction of the Printing Plate Cylinder |
| ϕ | Circumferential Direction of the Printing Plate Cylinder |
| r | Radial Direction of the Printing Plate Cylinder |

What is claimed is:

1. A printing plate cylinder for a printing machine, the cylinder comprising:

a cylinder mandrel that is rotatable in the printing machine;

a sleeve that is positionable in an axial direction (z) and in a peripheral direction (ϕ) over at least a portion of the cylinder mandrel;

a block that terminates movement of the sleeve in the axial direction (z) at a set position;

a male register element associated with the cylinder mandrel; and a female register element associated with the sleeve, a peripheral angular position of the cylinder mandrel and the sleeve with respect to each other being alignable through the male register element and the female register element, the male register element and the female register element being in working connection with each other if the cylinder mandrel and the sleeve are in a set alignment position relative to each other, and the male register element being located adjacent the block and (i) including a flat inclined surface having a uniform inclination configured to slidably engage the sleeve that is to be aligned as the sleeve is moved in the axial direction (z) and (ii) being controlled through the movement of the sleeve, the male register element being controllably movable by movement of the sleeve in the axial direction (z) of the printing plate cylinder, and, once the movement of the sleeve in the axial direction (z) has been terminated by the block at the set position, by movement of the sleeve in the peripheral direction (ϕ) of the printing plate cylinder.

2. The printing plate cylinder according to claim 1, wherein the movable male register element is configured to seat in at least a flush position in a circumferential surface of the sleeve.

3. The printing plate cylinder according to claim 1, wherein the movable male register element is in working connection with a spring element that (i) creates a feedback force and (ii) moves the male register element into an opening provided in the sleeve when the sleeve is in the set position.

4. The printing plate cylinder according to claim 3, wherein the male register element is a spring actuated element.

5. The printing plate cylinder according to claim 1, wherein a strike surface of the sleeve with the block is larger than a strike surface of the sleeve with the male register element.

6. The printing plate cylinder according to claim 5, wherein the block engages a circumference of the cylinder mandrel.

7. A method for equipping the printing plate cylinder according to claim 1, comprising:

placing the cylinder mandrel in the printing machine;

positioning the sleeve over the at least a portion of the cylinder mandrel; and moving the sleeve so as to (i) align the peripheral angular position of the cylinder mandrel and the sleeve with respect to each other and (ii) place the male register element in the working connection with the female register element.

8. The printing plate cylinder according to claim 1, wherein the inclined surface of the male register element inclines upwardly in the axial direction (z) toward the block.

9. The printing plate cylinder according to claim 1, wherein the male register element is configured to retract into the mandrel so as to be flush with an inner surface of the sleeve once the sleeve has been fully moved in the axial direction (z).

10. The printing plate cylinder according to claim 9, wherein the retracted male register element is configured to rebound, once the male register element is aligned with the female register element, into the female register element so as to effect the working connection.

11. The printing plate cylinder according to claim 10, wherein the female register element is configured as an opening in the inner surface of the sleeve.

12. A printing plate cylinder for a printing machine, the cylinder comprising:

a rotatable cylinder mandrel;

a sleeve that is movable in an axial direction (z) and in a peripheral direction (ϕ) relative to the cylinder mandrel so as to be received by the cylinder mandrel;

a block that terminates movement of the sleeve in the axial direction (z);

an actuatable male register element associated with the cylinder mandrel; and a female register element associated with the sleeve, a peripheral angular position of the cylinder mandrel and the sleeve with respect to each other being alignable through the male register element and the female register element so as to provide a working connection therebetween, the male register element being located adjacent the block and including a flat inclined surface having a uniform inclination configured to slidably engage the sleeve as the sleeve is moved in the axial direction (z), and being actuated through movement of the sleeve (i) in the axial direction (z) and (ii) in the peripheral direction (ϕ) relative to the cylinder mandrel, once the movement of the sleeve in the axial direction (z) has been terminated by the block.

13. The printing plate cylinder according to claim 12, wherein the male register element is a spring-actuated pin and the female register element is an opening in an inner peripheral surface of the sleeve that is configured to receive the pin so as to provide the working connection.

* * * * *